US005979004A

United States Patent [19]

Wilson

[11] Patent Number: 5,979,004

[45] Date of Patent: Nov. 9, 1999

[54] WRINGER MOPS WITH PIVOTING MOP HEADS

[76] Inventor: Frank G. Wilson, P.O. Box 1416, Malvern, Pa. 19355

[21] Appl. No.: 09/079,563

[22] Filed: May 15, 1998

[51] Int. Cl.[6] ..... A47L 13/146

[52] U.S. Cl. ..... 15/119.2; 15/244.2; 15/144.1

[58] Field of Search ..... 15/119.1, 119.2, 15/116.1, 116.2, 228, 244.1, 229.6, 144.1, 144.2

[56] References Cited

U.S. PATENT DOCUMENTS

| | | | |
|---|---|---|---|
| 727,035 | 5/1903 | Van Loan | 15/144.1 |
| 763,100 | 6/1904 | Howell . | |
| 842,770 | 1/1907 | Connelly . | |
| 1,989,825 | 2/1935 | Schaefer et al. . | |
| 2,029,235 | 1/1936 | Jenkins . | |
| 2,469,060 | 5/1949 | Vosbikian et al. . | |
| 2,472,781 | 6/1949 | Vosbikian et al. . | |
| 2,534,086 | 12/1950 | Vosbikian et al. . | |
| 2,637,059 | 5/1953 | Vosbikian et al. . | |
| 2,641,787 | 6/1953 | Vosbikian et al. . | |
| 2,643,407 | 6/1953 | Vosbikian et al. . | |
| 2,670,488 | 3/1954 | Richards et al. | 15/119.2 |
| 2,699,563 | 1/1955 | Duncan . | |
| 2,701,888 | 2/1955 | Vosbikian et al. . | |
| 2,740,146 | 4/1956 | Vaughn . | |
| 2,757,398 | 8/1956 | Richards et al. | 15/119.2 |
| 2,774,092 | 12/1956 | Vaughn . | |
| 2,802,230 | 8/1957 | Maddox . | |
| 2,834,035 | 5/1958 | Vosbikian et al. . | |
| 2,893,033 | 7/1959 | Vosbikian et al. . | |
| 2,895,152 | 7/1959 | Vosbikian et al. . | |
| 2,961,676 | 11/1960 | Rebernak et al. | 15/119.2 |
| 2,967,317 | 1/1961 | Richards . | |
| 3,026,554 | 3/1962 | Palma, Jr. et al. . | |
| 3,178,748 | 4/1965 | Heepe . | |
| 3,226,752 | 1/1966 | Antonucci, Jr. . | |
| 3,362,037 | 1/1968 | Griffin . | |
| 3,552,870 | 1/1971 | Brooks . | |

(List continued on next page.)

FOREIGN PATENT DOCUMENTS 323548 9/1957 Switzerland .

*Primary Examiner*—Gary K. Graham

*Attorney, Agent, or Firm*—Panitch Schwarze Jacobs & Nadel, P.C.

[57] ABSTRACT

Butterfly-type wringer mops each include a mop handle having an elongated direction, a receiver immovably coupled to one longitudinal end of the handle and a mop head pivotally attached to the receiver The mop head includes a central member pivotally mounted to the receiver. First and second paddles are pivotally coupled with opposing lateral sides of the central member. The central member and paddles can receive and support an elongated absorbent element. The mop further includes a wringer having one end pivotally coupled to one of the receiver and the central member so as to pivot between a retracted position and an extended position. The wringer includes a pair of spaced apart arms which deflect the paddles from initial positions generally coplanar with one another and transverse to the elongated direction of the mop handle to rotated positions generally side by side parallel to one another as the wringer moves between retracted and extended positions. The mop head can be pivoted on the receiver at least 45 degrees and preferably at least about 90 degrees or more from an initial position in which the elongated direction of the mop head is at least generally perpendicular to the elongated direction of the mop handle, so as to be parallel or at least more closely parallel with the elongated direction of the mop handle. The mop head can be pivoted in different ways. An upper portion of the central member of the head can be formed into a handle to be directly grasped or formed into an arm coupled by a rigid link to a lever pivotally mounted on the mop handle or provided with gear teeth engaged by teeth on the end of a shaft on or in the mop handle. Also the wringer can be used as a handle. An absorbent element that can be used on the mops has at least one and may have two tapered longitudinal tips, which may be of different material(s) from the main body of the element.

18 Claims, 8 Drawing Sheets

U.S. PATENT DOCUMENTS

| | | |
|---|---|---|
| 3,727,259 | 4/1973 | Wilson . |
| 3,911,521 | 10/1975 | Franchot . |
| 3,991,431 | 11/1976 | Thielen . |
| 4,219,899 | 9/1980 | Zurawin et al. . |
| 4,481,688 | 11/1984 | Graham . |
| 4,516,287 | 5/1985 | Johnson et al. . |
| 4,625,356 | 12/1986 | Meili . |
| 4,673,307 | 6/1987 | Prestele et al. . |
| 4,776,716 | 10/1988 | Huang . |
| 4,783,873 | 11/1988 | Young . |
| 4,850,075 | 7/1989 | Kresse et al. . |
| 4,908,901 | 3/1990 | Torres . |
| 5,097,561 | 3/1992 | Torres . |
| 5,253,387 | 10/1993 | Kresse et al. . |
| 5,272,783 | 12/1993 | Richardson et al. . |
| 5,331,706 | 7/1994 | Graham . |
| 5,410,771 | 5/1995 | Bereza . |
| 5,410,772 | 5/1995 | Lewis . |
| 5,455,978 | 10/1995 | Graham . |
| 5,488,750 | 2/1996 | Vosbikian et al. . |
| 5,528,791 | 6/1996 | Wilson . |
| 5,625,918 | 5/1997 | Kieson et al. . |

WRINGER MOPS WITH PIVOTING MOP HEADS

BACKGROUND OF THE INVENTION

U.S. Pat. No. 5,528,791 discloses a roller-type wringer floor mop with a pivoting head. This type of mop is normally symmetric with the handle positioned exactly perpendicular to the head. That is, the elongated central axes of the handle and of a sponge element on the head together generally define a single plane that divides both the head and the handle in half along their long dimensions. The elongated sponge element has a curved outer surface to provide a continuous contact surface when either side of the mop handle and head are pitched or inclined towards the user while being used. The mop handle is also pivotally mounted to the mop head so that the handle may be tilted from its original position exactly perpendicular to the mop head towards one of the long ends of the mop head so that the handle is inclined in the long direction of the head. This enables the user to more easily maneuver the head into narrow places.

Another type of wringer mop is known as the "butterfly" type. A butterfly-type mop normally includes an elongated handle fixedly attached to a central bracket member of the mop head. The central bracket member pivotally supports a pair of paddles on its opposing lateral sides. Collectively the central bracket member and the paddles mount and support an elongated sponge element. The elongated direction of the sponge element is generally perpendicular to the elongated direction of the mop handle. However, unlike the roller-type wringer mop, the sponge element of a butterfly-type wringer mop is generally square and flat and the handle extends from the head at an angle to the flat bottom of the sponge element and plane of the mop head to enable the full bottom surface of the sponge element to contact a floor surface with the handle of the mop pitched toward the mop user.

Butterfly-type mops are often equipped with a wringer in the form of a bent wire member having a pair of arms. Ends of the arms are pivotally attached to either side of the central bracket member in positions where, when the wringer is pivoted down, the arms ride over and cam the paddles down from their normal, generally coplanar positions to deflected, generally side-by-side parallel positions with the sponge element folded over between them. The wringer is typically operated by a collar which is slidably mounted on the mop handle and a link having one end pivotally coupled with the slide collar and a remaining end pivotally coupled with the wringer.

The utility of a butterfly-type wringer mops could be substantially increased if the head were made to pivot so that the handle lies in a common plane with the elongated direction of the head in the same way that the aforementioned roller-type wringer mop can be configured. However, differences in construction and operation preclude butterfly-type wringer mops from being able to use the construction of the aforesaid roller-type wringer mop with tilting handle.

BRIEF SUMMARY OF THE INVENTION

In one aspect, the invention is a wringer mop comprising: a mop handle having an elongated direction between opposing longitudinal ends; a receiver coupled to one longitudinal end of the handle; a mop head pivotally attached to the receiver on the one longitudinal end of the mop handle, the mop head including a central member pivotally mounted on the receiver and first and second paddles pivotally coupled with opposing lateral sides of the central member, the central member and paddles being adapted to collectively receive and support an elongated absorbent element; and a wringer having one end pivotally coupled to one of the central members and the receiver so as to pivot between a retracted position and an extended position, the wringer including a pair of spaced apart arms, ends of the arms being pivotally attached to the one of the central member and receiver, the arms being located to deflect the first and second paddles from initial positions generally coplanar with one another and transverse to the elongated direction of the mop handle to deflected positions rotated about 90° from the initial positions so as to be spaced apart and generally side by side parallel to one another with any elongated absorbent element supported from the mop head folded over between the paddles, as the wringer moves from the retracted position to the extended position.

In another aspect, the invention is a wringer mop comprising: a mop handle having an elongated direction between opposing longitudinal ends; a receiver coupled to one longitudinal end of the handle; a mop head pivotally attached to the receiver on the one longitudinal end of the mop handle, the mop head including a central member pivotally mounted on the receiver and first and second paddles pivotally coupled with opposing lateral sides of the central member, the central member and paddles being adapted to collectively receive and support an elongated absorbent element on sides of the paddles opposite the mop handle, the central member rotating at least about 90 degrees on the receiver, the central member including a plurality of gear teeth; and a wringer having one end pivotally coupled to one of the central member and the receiver so as to pivot between a retracted position and an extended position, the wringer including a pair of spaced apart arms, ends of the arms being pivotally attached to the one of the central member and receiver, the arms being located to deflect the first and second paddles from initial positions generally coplanar with one another and transverse to the elongated direction of the mop handle to deflected positions rotated about 90° from the initial positions so as to be spaced apart and generally side by side parallel to one another with any elongated absorbent element supported from the mop head folded over between the paddles, as the wringer moves from the retracted position to the extended position.

In yet another aspect, the invention is a wringer mop comprising a mop handle having an elongated direction between opposing longitudinal ends; a receiver coupled to one longitudinal end of the handle; a mop head pivotally mounted on to the receiver on the one longitudinal end of the mop handle, the mop head including an integral central member rotatably engaged with the receiver and first and second paddles pivotally coupled with opposing lateral sides of the central member, the central member and paddles being adapted to collectively receive and support an elongated absorbent element on sides of the paddles opposite the mop handle, the central member being rotatable more than 90 degrees on the receiver without relative axial displacement between the mop head and the receiver; and a detent between the central member and receiver releasably engaging the central member and the receiver at at least a pair of rotational positions of the central member 90 degrees apart from one another on the receiver.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown. In the drawings.

DETAILED DESCRIPTION OF THE INVENTION

Figure 1:
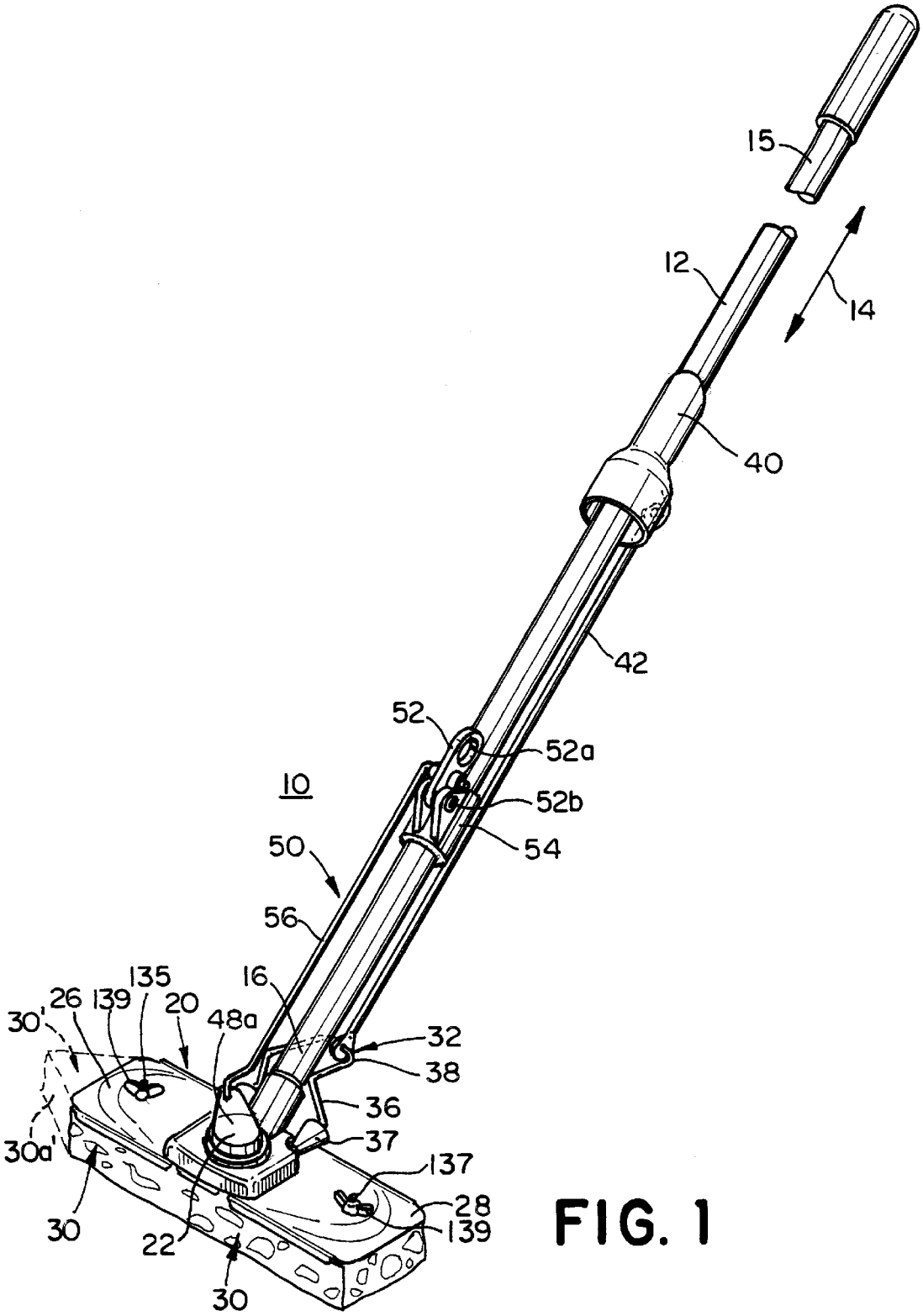
FIG. 1 is a perspective view of a butterfly-type wringer mop of the present invention with a pivotable head in its nominal or normal or initial operating position and the wringer in its nominal or normal retracted position.

In the drawings, like numerals are used to indicate like elements throughout. A butterfly-type wringer mop of the present invention is indicated generally at 10 in the first five figures. The wringer mop 10 comprises a mop handle 12 having an elongated direction 14 extending between opposing longitudinal ends 15 and 16. A mop head indicated generally at 20 is pivotally attached to one of the longitudinal ends 16 of the mop handle 12 by means of a receiver 18, which is a bracket member coupled to the one longitudinal end 16 of the mop handle 12. In this embodiment 10, the end 16 is preferably immobily coupled to the receiver 18. The mop head 20 includes a central member 22, an upper portion of which extends through the top of receiver 18. Central member 22 is pivotally mounted on the receiver 18. The mop head 20 further includes first and second paddles 26, 28, which are pivotally coupled with opposing the lateral sides of the central member 22 in a manner indicated generally in FIGS. 2. The central member 22 and paddles 26 and 28 are adapted in a conventional manner to collectively mount and support an elongated, absorbent element 30 (in solid) or 30' (in phantom) such as a replaceable sponge element. Element 30/30' is omitted from FIGS. 2–4 for clarity of the mop head elements. As used herein, "pivotally" means to rotate at least partially around an axis.

Figure 2:
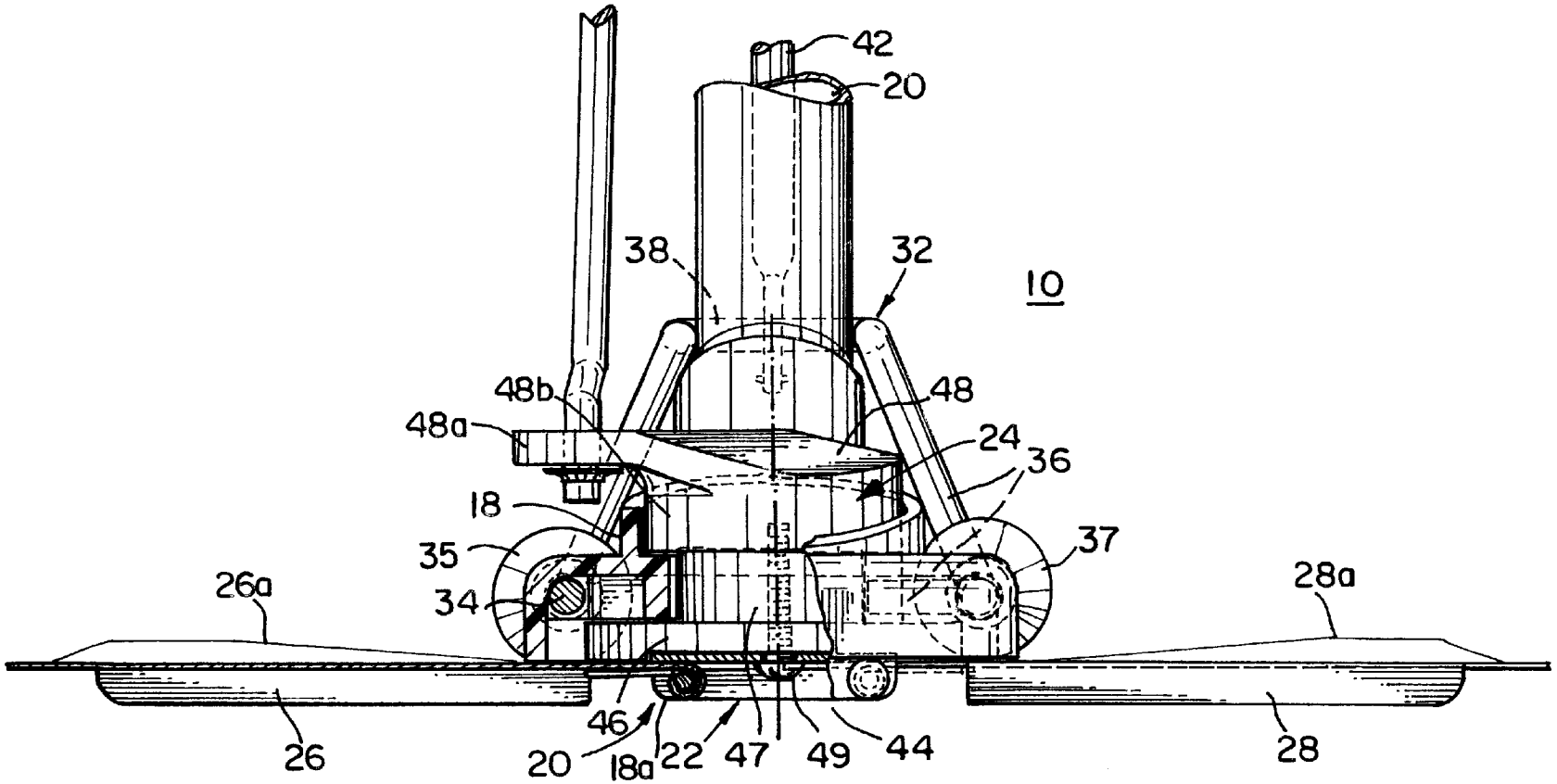
FIG. 2 is a partially broken away front elevation of the head of the wringer mop of FIG. 1.
Figure 3:
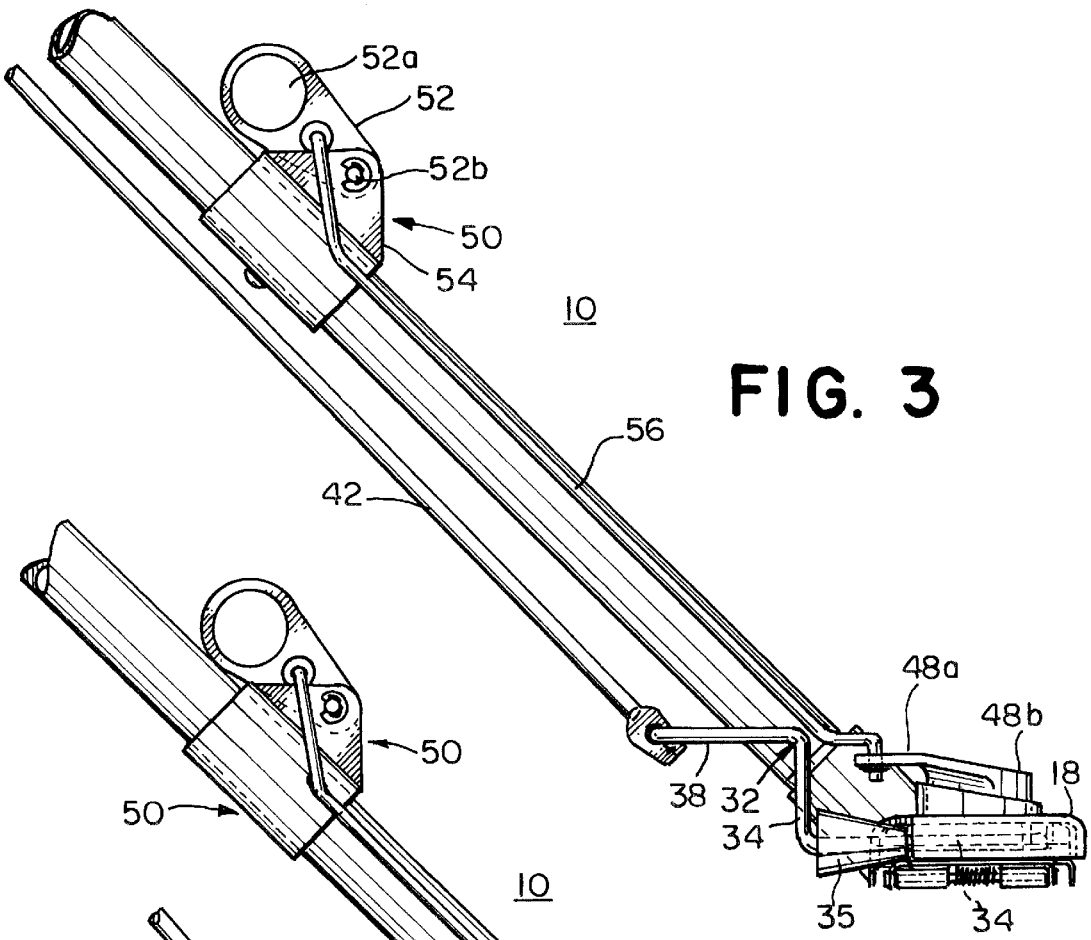
FIGS. 3 and 4 are side elevation views of the lower portion of the mop of FIGS. 1 and 2 with the wringer in its respective retracted and extended positions.
Figure 4:
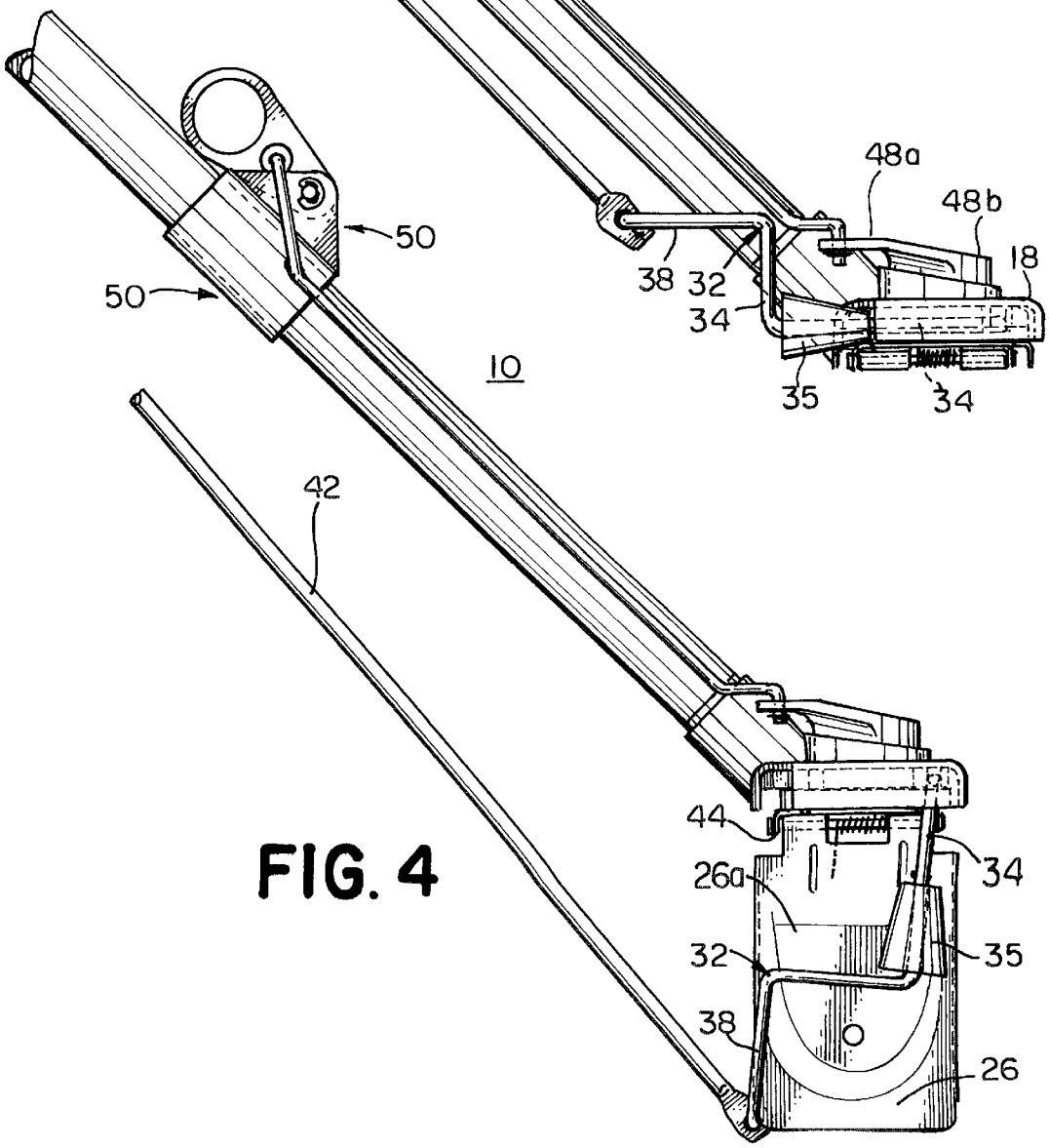

The wringer mop 10 further includes a wringer indicated generally at 32 having one end coupled with one of the receiver 18 and central member 22 so as to pivot between a retracted position shown in FIGS. 1–3 and an extended position shown in FIG. 4. Wringer 32 is conventionally formed from a single length of wire bent to provide a pair spaced apart preferably parallel and symmetric arms 34, 36. Ends of the arms 34, 36 are preferably pivotally attached to the receiver 18 in the manner shown in FIGS. 2 through 4 in which the extreme ends of the arms 34, 36 are turned at right angles and extended toward one another with the turned ends being trapped between opposing but spaced apart portions of the central member 22 and the receiver 18. The wringer arms 34, 36 are shaped and located on the mop head 20 so as to deflect the first and second paddles 26, 28 from initial or normal positions shown in FIGS. 1–3, in which they are generally coplanar with one another and generally transverse to the elongated direction 14 of the mop handle 12, to deflected positions shown in FIG. 4 in which they are rotated about 90° from their normal or initial positions so as to be spaced apart but generally side by side parallel to one another with the elongated absorbent element (e.g., 30 or 30') folded over between the paddles 26, 28, as the wringer 32 moves from the retracted position shown in FIG. 3 to the extended position shown in FIG. 4. Preferably and conventionally, the arms 34, 36 of wringer 32 are connected by a yoke portion 38 of the bent wire, which forms a handle that projects generally away from the receiver 18 and mop head 20 in the retracted position of the wringer. Preferably and conventionally, conical rollers 35 and 37 are rotatably mounted on each of the arms 34, 36 to actually contact the exposed, upper surfaces of the paddles 26, 28 and to enable the arms 34, 36 to easily traverse the exposed, upper surfaces of the paddles 26, 28 as the paddles are deflected from their initial, coplanar positions. The paddles 26, 28 can be provided with raised cam surfaces **26*a*, 28*a* over which the rollers 35, 37 run. Referring back to FIG. 1, the wringer mop 10 further includes a collar 40 slidably mounted on the mop handle 12 and a link 42 or connecting rod having one end pivotally coupled with the collar 40 and an opposing end pivotally coupled with the yoke 38 of wringer 32** in a conventional fashion.

Referring now to the broken away views of the mop head 20 in FIG. 2, it can be seen that the central member 22 is an assembly. It includes a hub 24 which passes through a bore **18*a* in the receiver and rotates in the receiver 18 about a central axis 24'. The central member 22 also includes a generally planar, rectangular base 44 on the opposing lateral sides of which the paddles 26, 28 are pivotally mounted. The base 44 forms a "body" of a "butterfly" assembly, which includes the paddles as "wings". The base 44 is fixed to the hub 24. The hub 24 includes a bushing 46, which is located on and fixedly coupled with an upper side of the base 44 and which is preferably rotatably mounted against a lower side of the receiver 22. The bushing 46 supports the base 44 for rotation with respect to the receiver 18. Hub 24 preferably includes a shaft 47 which is rotatably received in the bore 18*a*. Hub 24 further preferably includes an upper end 48 which is fixedly coupled with the shaft for rotation with the shaft 47 and base 44 on an upper surface of the receiver 18. The upper end 48 is exposed on the upper side of the receiver 18. In this embodiment, the upper end 48 is preferably formed into an arm 48*b* extending from a shaft portion 48*a* which is partially received in the bore 18*a* of the receiver 18, and which supports the arm 48*b*, as it extends transversely away from the shaft portion 48*a* and from of the axis of rotation 24' of the hub 24, central member 22 and mop head 20 on receiver 18. The hub 24 may be formed from separate components 46, 47 and/or 48 fixedly joined together and with rectangular base 44 by suitable means such as a screw 49 or other fastener(s) or adhesive(s) or both. Alternatively, the hub 24 can be formed from fewer than three or more than three component members. Also, the base member 44 may be formed in one piece with the hub 24 or at least part of the hub, for example, the bushing 46. The receiver 18 is preferably one piece but may be of a multi-piece construction, particularly if the hub 24** is of a one piece construction.

Lastly, the mop 10 includes a manual actuator, indicated generally at 50 in FIGS. 1, 3, 4 and 5, which is coupled with the central member 22 and which is mounted on mop handle 12 for pivoting the mop head 20 on the receiver 18. The actuator 50 includes a lever 52, which is pivotally coupled at one end with the mop handle 12 by means of a bracket 54 for movement with respect to the mop handle 12. The bracket is fixedly attached to the mop handle 12. More particularly, lever 52 is pivotally coupled with the arm 48*b* by a rod or other form of link 56 which is itself pivotally coupled at one end with the arm 48*b* and pivotally coupled at a remaining end with lever 52. A "free" end of the lever 52 may be provided with a finger hole 52*a* to assist in use of the lever 52. The end of link 56 is preferably attached to lever 52 between the pivot 52*b* of the lever and the mop handle 12 for over-center locking of the lever 52 in either of its end positions.

Figure 5:
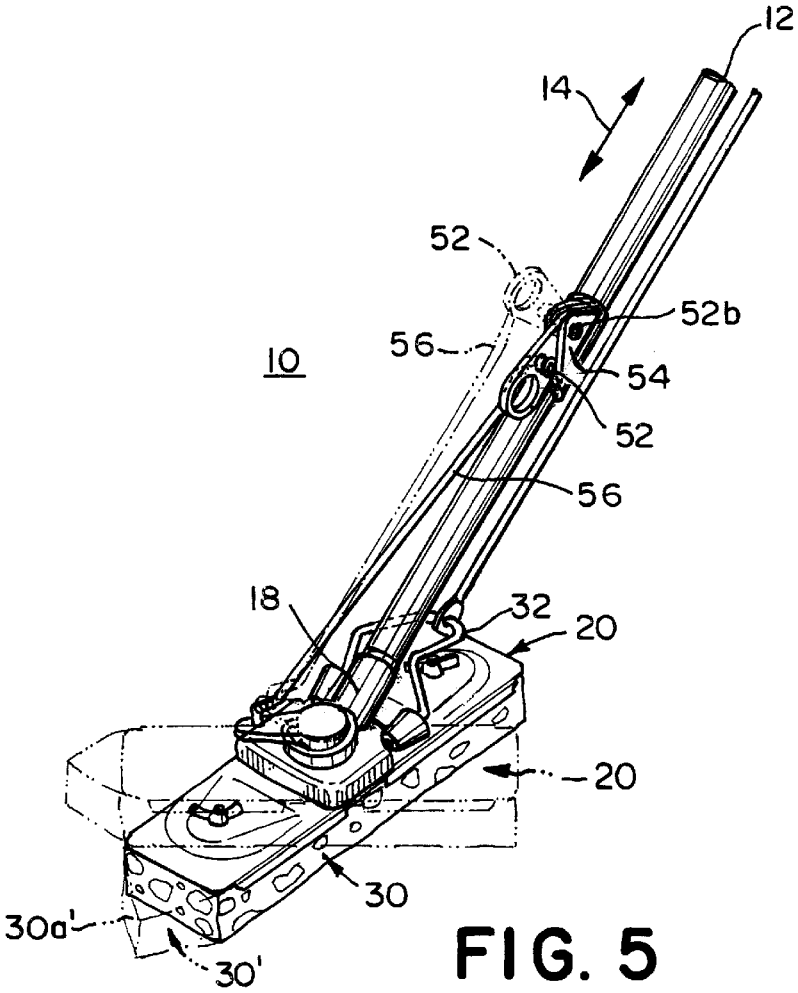
FIG. 5 is a perspective elevation of the wringer mop of FIGS. 1–4 showing the mop head rotated.

FIG. 5 depicts partial and full rotation, respectively of the mop head 20 on the receiver 18, first about 45° in phantom and then about 90° in solid as lever 52 is correspondingly rotated first about 90° (phantom) and then about 180° (solid) on the bracket 54 from its initial position (FIG. 1) on the mop handle 12. In the fully rotated position in the mop head 20, the elongated direction of the absorbent pad 30 and mop head 20 is generally coplanar with the elongated direction 14 of the mop handle 12.

Figure 7:
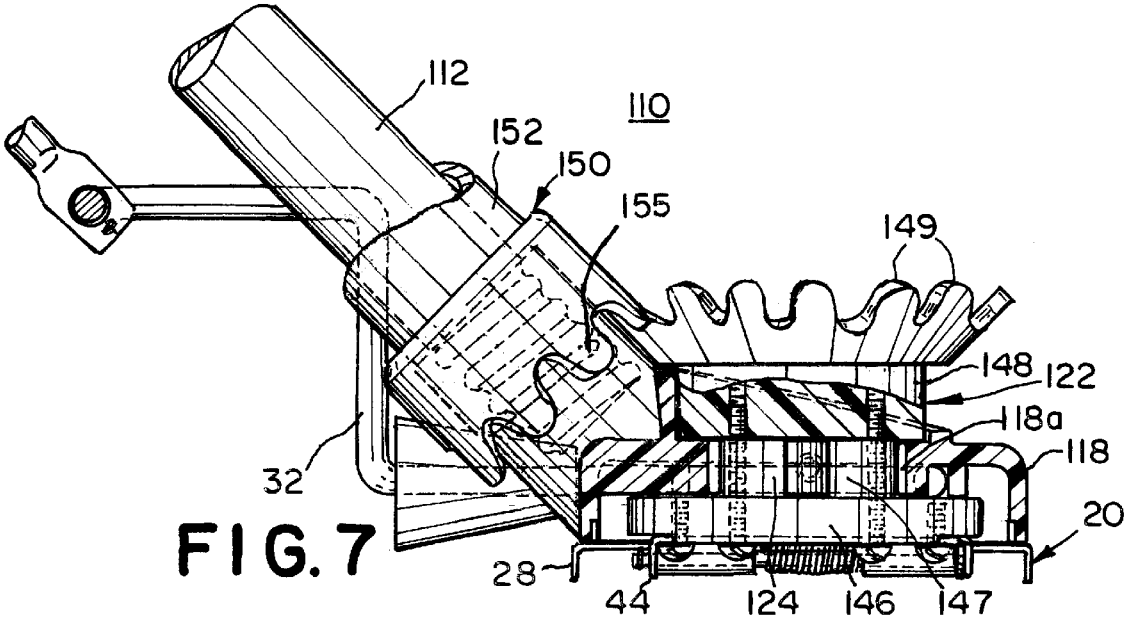
FIG. 7 is a partially broken away side elevation of the wringer mop of FIG. 6.
Figure 6:
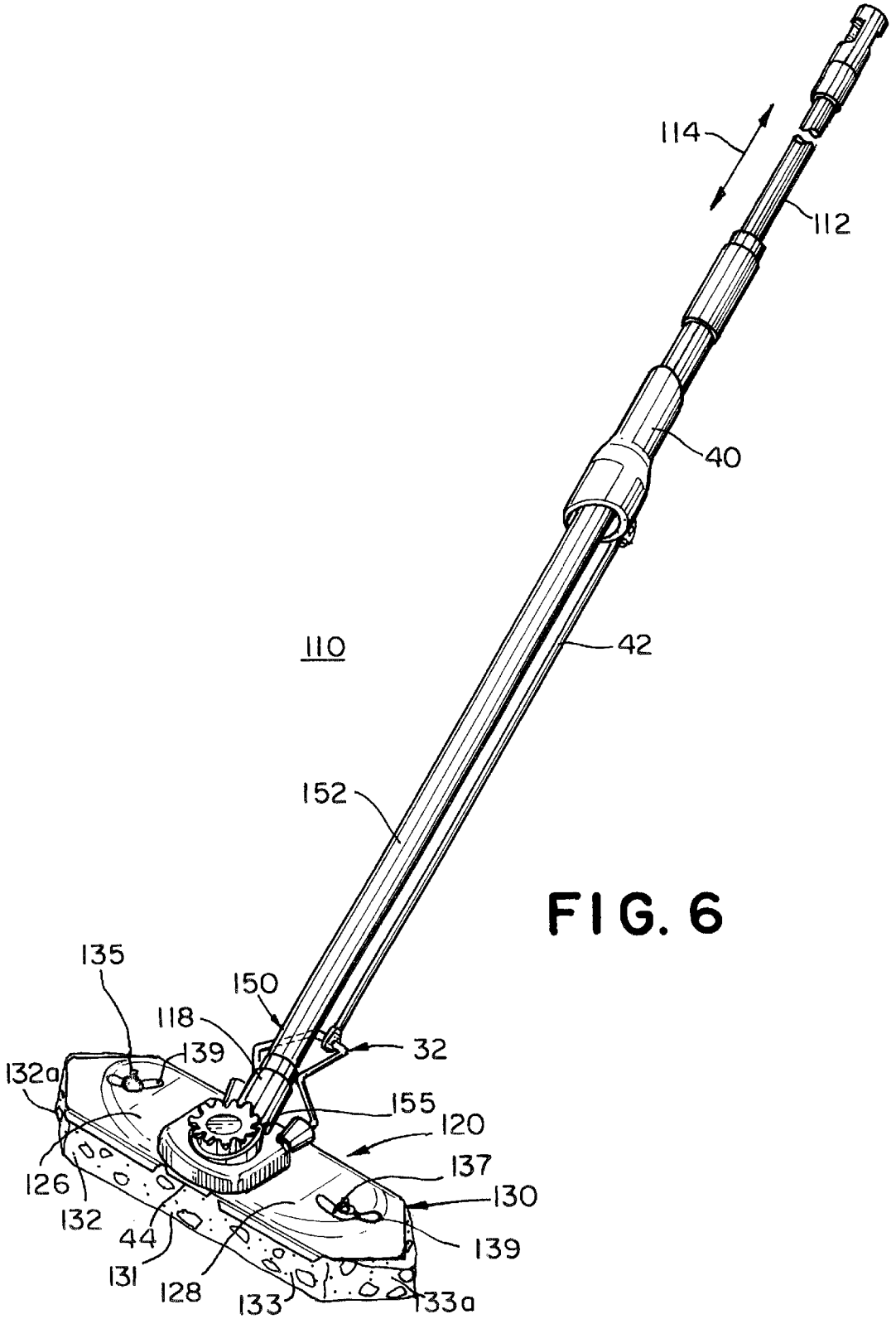
FIG. 6 is a perspective view of a second embodiment butterfly-type wringer mop.
Figure 8:
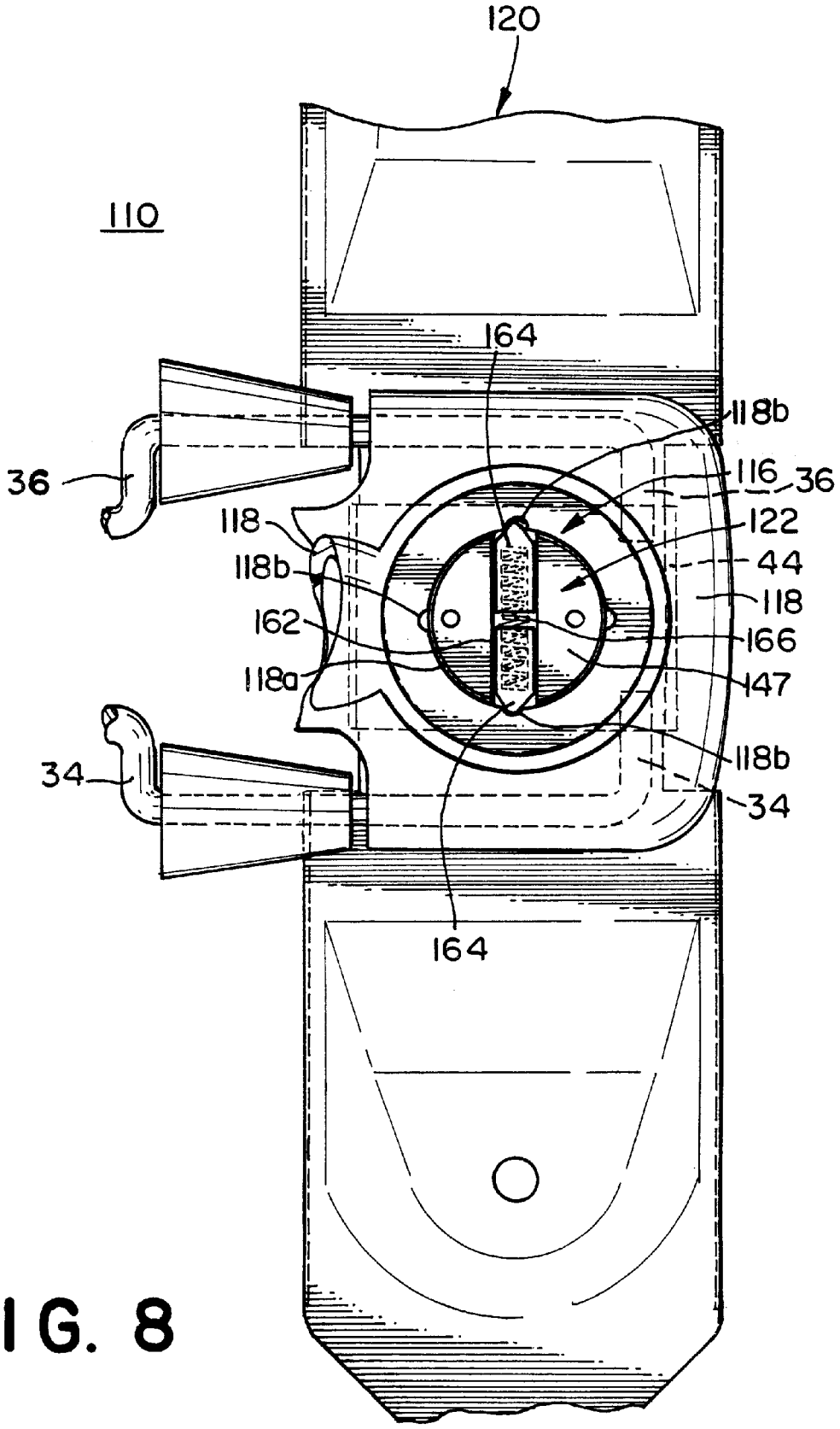
FIG. 8 is a partially broken, top plan view of the mop head of FIGS. 6 and 7.

FIGS. 6 through 8 depict and second embodiment butterfly-type wringer mop of the present invention indicated generally at 110. Wringer mop 110 comprises an elongated mop handle 112 in an elongated direction 114 extending between opposite longitudinal ends. A mop head indicated generally at 120 is attached to one of the longitudinal ends of the mop handle 112 by means of a receiver 118. Again, receiver 118 is a bracket member coupled, preferably immovably coupled, to the one longitudinal end of the mop handle 112. Mop head 120 includes a central member 122 again formed by a rectangular base 44 connected to a hub 124 (see FIG. 7). First and second panels 126 and 128 are pivotally coupled to opposing lateral sides of the base 44. The "butterfly" formed by base member 44 and panels 126, 128 is the same as that of the first embodiment mop 10 except for the triangular extensions of the outer, free ends of the panels. An elongated, absorbent element 130, preferably a sponge element, is mounted to the mop head 120. Preferred element 130 is shown separately in FIGS. 12–16 and is omitted from FIGS. 7 and 8 for clarity of the remaining elements.

Mop 110 further includes a manual actuator indicated generally at 150 coupled with the central member 122 and mounted on the mop handle 112 for movement with respect to that handle. More particularly, the manual actuator 150 includes a hollow shaft 152 concentrically positioned around the mop handle 112 and bearing a plurality of gear teeth 155 at its lower end adjoining the central member 122. The central member 122 includes a hub 124 best seen in FIG. 7, again including a bushing 146, a shaft 147 which extends through a central bore 118*a* in the receiver 118 and an upper end 148 bearing a plurality of gear teeth 149. The gear teeth 155 of the manual actuator are engaged with the gear teeth 149 of the upper end 148 of the central member 122. Preferably, the shaft 152 can be rotated in either direction on the mop handle 112 causing the mop head 120 to rotate without limit (more than 360 degrees) in either direction on the receiver 118.

There are several possible variations to this design. For example, the handle with gear teeth at one end can be rotatably mounted on the receiver, for example, the toothed end of the shaft passing through and rotating in a hollow sleeve on the receiver where it engages gear teeth provided on the hub/central member of the mop head. The wringer would also rotatably mounted on the receiver as in the first two embodiments of FIGS. 1–7. The mop head can be rotated by twisting the mop handle while holding the wringer slide collar. This design eliminates the fixed mop handle of the embodiment of FIGS. 6–7. It is suggested in such design(s) to tighten and strengthen the pivots of the wringer subassembly, particularly those between link 42 and each of the slide collar 40 and the yoke 38 of the wringer 32, to better withstand the twisting loads as well as the conventional compressive loads being imposed. If desired, the end of the mop handle bearing the gear teeth can be located inside the receiver together with the gear teeth on the hub/central member of the mop head so that the gear engagement is hidden from view. In yet another variation, the gear teeth supporting mop handle/shaft can be rotatably positioned concentrically within an outer hollow shaft having an end that is non-rotatably fixed with the receiver and the teeth on the inner shaft engaged with teeth provided on the hub/central member within the receiver so that the gear mechanism are hidden within the receiver and the wringer subassembly is relieved from twisting loads.

While gear teeth are preferred, known substitutes can be used. For example, a universal joint or a flexible collar or any other equivalent member or device for transferring rotational motion between a pair of non-parallel shafts can be used to connect together in or on the receiver, an end of the mop handle or other shaft and an upper end of the hub/central member of the mop head where both the mop handle/shaft and the mop head with hub/central member are rotatably mounted on the receiver. Also, high friction contact surfaces may be provided on the ends of the rotatable shaft and the hub/central member in contact engagement with one another in place of the gears, universal joint, etc. fixed to ends of the mop handle/shaft and hub/central member. Lastly, the slide collar 40 and link 42 could be eliminated with the wringer kept rotatably supported on the receiver. The yoke of the wringer is used as a handle to immobilize the receiver while the mop head is rotated with the mop handle or other shaft rotatably mounted or the receiver and engaged with the hub/central member.

Referring to FIG. 8, preferably a detent indicated generally at 116 is provided between the central member 122 and the receiver 118 releasably engaging the central member 122 and receiver 118 at at least a pair of rotational positions of the mop head 120 located about 90 degrees from one another on the receiver 118. Preferably a passage 162 is provided through the shaft portion 147 of the hub 124, for example, in the upper side of the shaft 147 where the shaft 147 abuts the upper end 148 (removed in FIG. 8 for clarity) of the hub 124. The passage 162 is provided with at least one and preferably a pair of opposing elements 164 which are biased apart, for example, by a coil spring 166, such that they can intercept any of four depressions 118*b* at rotational positions of the mop head 120 located at about 90 degrees from one another on the receiver 118. Thus, the mop head 120 is releasably engaged to rotate between a normal position shown in FIGS. 6 and 8, where the longitudinal axis of the mop head 120 is transverse to the elongated direction 114 of the mop handle and orthogonal positions of the mop head 120 in which the elongated direction of the mop head 120 is substantially parallel and preferably coplanar with the elongated direction 114 of the mop handle 112. The same wringer 32, collar 40 and link 42 can be provided for pivoting the panels 26, 28 and wringing any sponge element 130 (or 30 or 30') mounted on the mop head 120 folded over between the panels.

Figure 9:
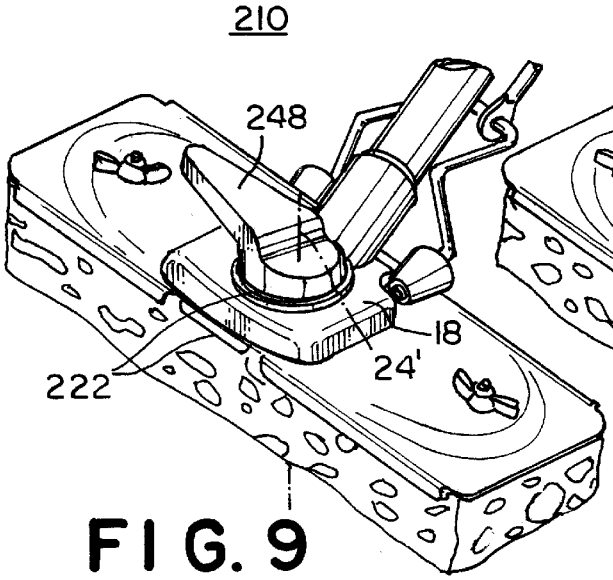
FIG. 9 is a perspective view of a third embodiment mop head.
Figure 10:
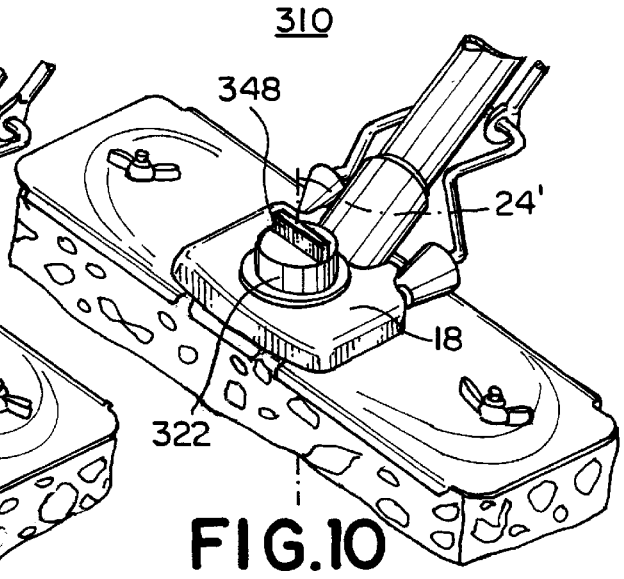
FIG. 10 is a perspective view of a fourth embodiment mop head.

FIGS. 9 and 10 depict other possible configurations of manual handles. FIG. 9 depicts a handle 248 provided on a central member 222 pivotally mounted on a receiver 18 in a third embodiment wringer mop 210 while FIG. 10 depicts yet another configuration of a handle 348 provided on a central member 322 pivotally mounted on a receiver 18 of a fourth embodiment wringer mop 310. As can be seen in FIG. 9, the handle 248 is formed by an elongated arm portion which extends transversely away from only one side of the axis of rotation 24' of the central member of the mop head 220 on receiver 18 sufficiently to be encircled by the user's fingers and manually gripped. In FIG. 10, the handle 348 if formed by an elongated raised portion spanning the axis of rotation 24' of the central member 322 on the receiver 18 of mop 310 to be only partially encircled and gripped on opposing sides only by the user's fingers. Handles of other shapes, for example, generally spherical or polyhedronal shapes, can be provided for manual gripping and rotating the mop head.

Figure 11:
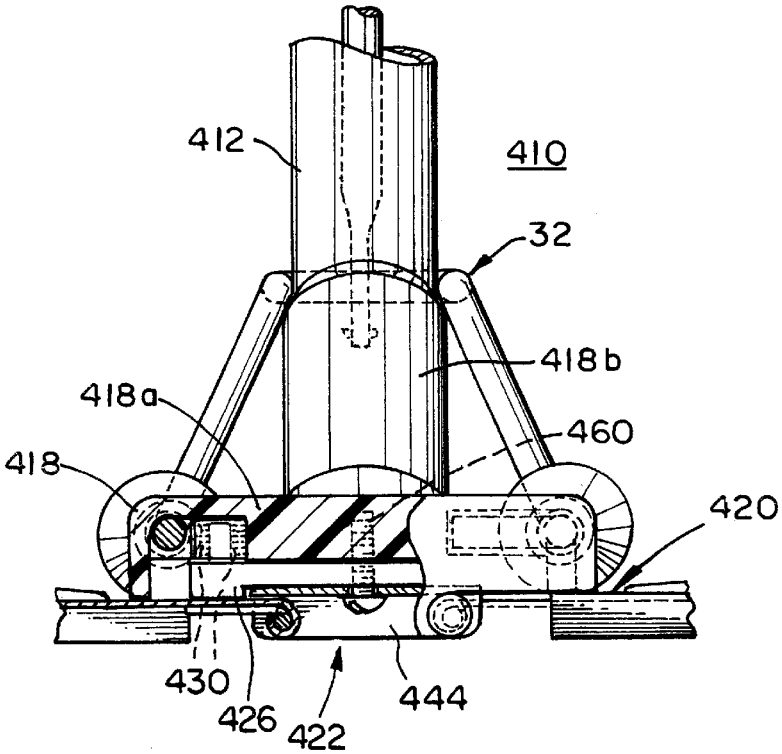
FIG. 11 is a perspective view of a fifth embodiment mop head.
Figure 12:
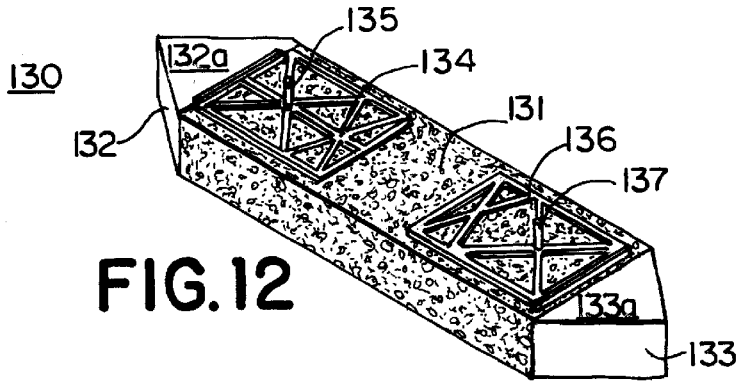
FIG. 12 is a perspective view of a replaceable sponge element.
Figure 13:
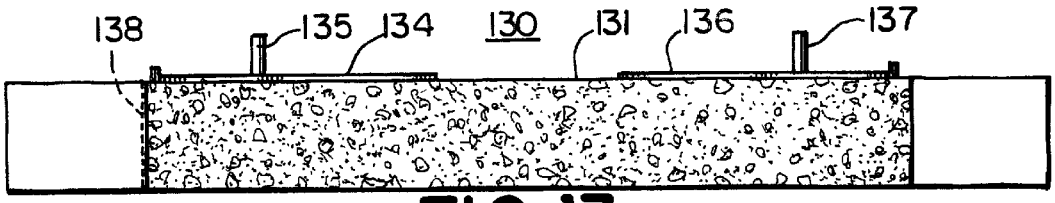
FIGS. 13–16 are respective front and side elevation and top and bottom plan views of the sponge element of FIG. 12.
Figure 14:
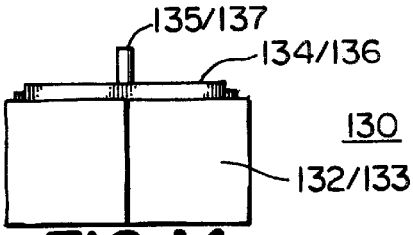
Figure 15:
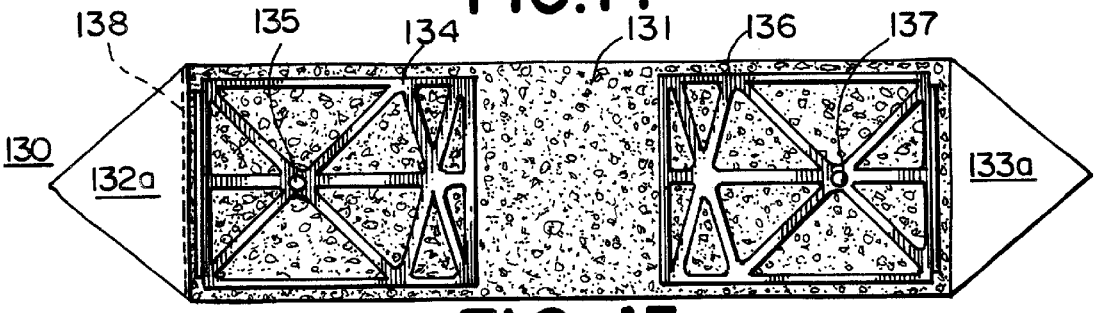
Figure 16:
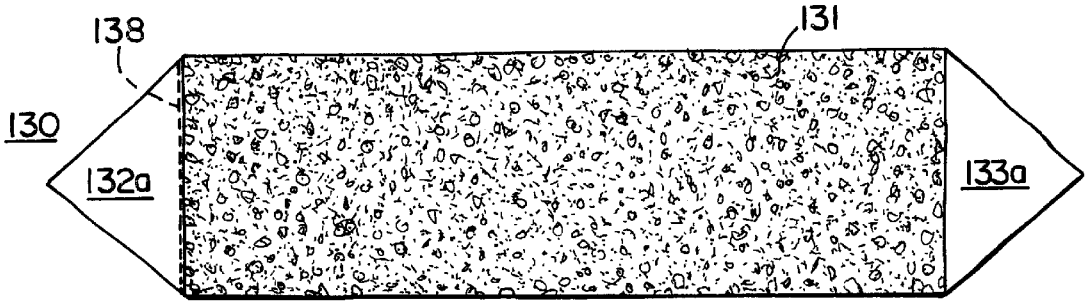

FIG. 11 also depicts yet a fifth butterfly-type wringer mop embodiment 410 in which the mop head 420 is pivotally attached to a receiver 418. In this embodiment, the central member 422 is formed by base 444 and an annular bushing 426, which are both rotatably held to the receiver 418 by means of a pivot pin 460 (in phantom). Pivot pin 460 may be provided, for example, by a screw as shown or a rivet or like element fixed to the receiver 418. Pin 460 rotatably supports the base 444 and bushing 426 from the receiver 418. In an alternative design (not depicted), a screw could be used as a pivot pin and fixedly secured to the base and passed through the bushing and through the receiver to a separate upper portion on the top of the receiver, which would have a threaded blind bore located to receive and fixedly engage the upper threaded end of the screw forming the pivot pin. The mop head 420 is rotated by manually gripping the head 420 itself and turning it on receiver 418. In a variation mentioned earlier, a ring of teeth 430 (broken away and in phantom) can be provided on the upper surface of the bushing 426 surrounding the descending portion 418*a* of the receiver and can be engaged by bevelled teeth (hidden on the back side of the figure) on the end of handle 412, which would be rotatably received in sleeve portion 418*b* of receiver 418 . Either variation of the FIG. 11 embodiment can be equipped with detents as in FIG. 8.

In addition to having the mop head being pivotally supported from the receiver by having the hub or a pivot pin pass through a central opening through the receiver, the central member of the mop head can be configured to partially surround and rotate on a mating portion of the receiver. For example, the receiver can be at least partially cylindrically or spherically shaped and the central member of the mop head configured to partially wrap around and rotatably engage the receiver like a loose C clamp. At least one axial face of the central member or receiver would protrude into an axial recess in the remaining one of the central member and receiver for pivotal engagement of the two. In another variation, the collar 40 and link 42 used to actuate the wringer 32 could be eliminated and the wringer 32 actuated manually by directly grabbing the yoke 38. Such an arrangement would permit the wringer to be pivotally coupled to either the receiver or the central member of any of the foregoing embodiments. In this variation, the wringer can be pivotally attached to the central member of the mop head, the slide collar and link eliminated and the wringer gripped directly to both wring the mop head and pivot the mop head on the mop handle. Alternatively, the wringer is pivotally attached to the receiver and the mop head rotated by the mop handle which is coupled for rotation to the mop head through the receiver.

FIGS. 12–16 depict a preferred elongated absorbent sponge element 130 for use with at least butterfly-type wringer mops 110 ,310 and 410 in which the head rotates in either direction from its normal initial position transverse to the mop handle. Element 130 includes a main sponge body 131 having a rectangular cross-section and a pair of mounting stub shafts 135, 137 projecting away from one major side thereof. The stub shafts can be part of a single backing member extending along that side of the sponge body or, as indicated, parts of mirror image and preferably identical backing members 134, 136 mounted in a conventional manner, for example, by adhesion, on the one major side at opposite ends of the sponge body 131. At least one and preferably both of the elongated ends 132, 133 taper down in transverse width as the end projects away from the remainder of the sponge body 131 and from the mop head receiver when the element 130 is mounted on one of the above-described mop heads forming tapered, generally triangular tips 132*a*, 133*a*. The backing members 134 and 136 can be skeletal as indicated or solid or a combination and can be extended over the tapering elongated ends 132, 133 to cause the tips of those ends to be partially compressed when the element 130 is wrung in a conventional manner in the aforesaid mops. Alternatively or in addition, the elongated outer ends of the paddles 26, 28 can also be downwardly tapered in width similarly to the shape of the element 130 to overlap and compress and thereby assure more complete wringing of the tips 132*a*, 133*a*. The tapered tips 132*a*, 133*a* extend more completely into corners and recesses, particularly when the mop head is rotated on the receiver to generally lie in a common plane with the mop handle. Here both tapered tips 132*a*, 133*a* may be formed in one piece from the same material as the rest of the sponge body 131 or one or both ends may be formed of a different material, for example, a coarser, harder scrubbing or scouring material like nylon mesh. Also, only one end of the element 130 may be tapered with the remaining end squared off in a conventional fashion as indicated by phantom side 138. Such a single tapered tip element is indicated in FIG. 1 by phantom tip 30*a*' on solid, rectangular element 30 forming element 30' having the one tapered end.

While the mop head has been shown to be rotatable at least 90 degrees in all embodiments (and 360 degrees plus in some embodiments), it will be appreciated that at least some of the benefits of the invention can be achieved without complete alignment of the long direction of the mop head with the long direction of the mop handle. That is, it is still noticeably easier to get the mop head into narrower spots and the long edge of the sponge element along edges if the mop head is rotated at least 45 degrees and more desirably, at least 60 degrees from the normal or nominal working position of the head with its elongated direction generally perpendicular to the elongate direction of the mop handle. Furthermore, even at the 90 degree position(s), angular exactness is not necessary. Thus, the term "about 90 degrees" when referring to the pivoting movement or position of the mop head on the receiver, covers movements or positions of at least between 80 and 100 degrees. However, when referring to movement of the paddles 26, 28, 126, 128, "about 90 degrees" refers to rotations of at least 60 degrees or more.

It will be appreciated by those skilled in the art that changes could be made to the embodiments described above without departing from the broad inventive concepts thereof. It is understood, therefore, that this invention is not limited to the particular embodiments disclosed, but it is intended to cover modifications within the spirit and scope of the present invention as defined by the appended claims.

I claim:

1. A wringer mop comprising:

a mop handle having an elongated direction between opposing longitudinal ends;

a receiver coupled to one longitudinal end of the handle;

a mop head pivotally attached to the receiver on the one longitudinal end of the mop handle, the mop head including a central member pivotally mounted on the receiver and first and second paddles pivotally coupled with opposing lateral sides of the central member, the central member and paddles being adapted to collectively receive and support an elongated absorbent element on sides of the paddles opposite the mop handle, the central member and receiver including surfaces permitting rotation of the central member at least 45 degrees or more on the receiver from an initial position of the mop head extending at least perpendicularly to the elongated direction of the mop handle without any relative axial displacement between the mop head and the receiver; and a wringer having one end pivotally coupled to one of the central member and the receiver so as to pivot between a retracted position and an extended position, the wringer including a pair of spaced apart arms, ends of the arms being pivotally attached to the one of the central member and receiver, the arms being located to deflect the first and second paddles from initial positions generally coplanar with one another and transverse to the elongated direction of the mop handle to deflected positions rotated about 90° from the initial positions so as to be spaced apart and generally side by side parallel to one another with any elongated absorbent element supported from the mop head folded over between the paddles, as the wringer moves from the retracted position to the extended position.

2. The wringer mop of claim 1 wherein the central member includes an upper portion exposed on an upper side of the receiver with the mop handle, the upper portion being shaped and sufficiently large in size to be manually grasped to rotate the mop head on the receiver.

3. The wringer mop of claim 1 further comprising a manual actuator coupled with the central member and mounted on the mop handle for movement with respect to the handle.

4. The wringer mop of claim 3 wherein the central member includes an arm extending transversely away from an axis of rotation of the central member on the receiver, wherein the manual actuator comprises a lever pivotally coupled at one end with the mop handle, and wherein the mop further comprises a link pivotally coupled at one end with the arm of the central member and pivotally coupled at another end with the lever.

5. The wringer mop of claim 3 wherein the central member includes a plurality of gear teeth and wherein the manual actuator includes a shaft concentrically positioned with the mop handle and bearing a plurality of gear teeth at one end engaged with the gear teeth of the central member.

6. The wringer mop of claim 1 wherein ends of the wringer arms are pivotally attached to opposite sides of the receiver.

7. The wringer mop of claim 1 wherein the central member rotates more than 90 degrees on the receiver and further comprising a detent between the central member and receiver releasably engaging the central member and receiver at at least a pair of rotational positions of the mop head located about 90 degrees from one another on the receiver.

8. The wringer mop of claim 1 further comprising the elongated absorbent element removably attached to the mop head.

9. The wringer mop of claim 8 wherein at least one elongated end of the absorbent element tapers down in width as the one end projects away from a remainder of the absorbent element and the receiver.

10. The wringer mop of claim 1 wherein the mop head rotates at least 90 degrees on the receiver.

11. The wringer mop of claim 10 further comprising a manual actuator coupled with the central member and mounted on the mop handle for movement with respect to the handle, the manual actuator being shaped and sufficiently large in size to be manually grasped to rotate the mop head on the receiver.

12. The wringer mop of claim 11, wherein the central member includes a plurality of gear teeth and wherein the manual actuator includes a shaft concentrically positioned with the mop handle and bearing a plurality of gear teeth at one end engaged with the gear teeth of the central member.

13. The wringer mop of claim 12 wherein the mop handle is hollow and the shaft is located within the mop handle.

14. The wringer mop of claim 13 further comprising a detent on one of the central member and receiver releasably engaging with a remaining one of the central member and receiver at at least a pair of rotational positions of the mop head located about 90 degrees from one another on the receiver.

15. The wringer mop of claim 14 in combination with an elongated absorbent element removably mounted on the mop head to permit replacement.

16. The wringer mop of claim 15 wherein at least one elongated end of the absorbent element tapers down in width as the one end projects away from a remainder of the absorbent element and the receiver.

17. A wringer mop comprising:

a mop handle having an elongated direction between opposing longitudinal ends;

a receiver coupled to one longitudinal end of the handle;

a mop head pivotally attached to the receiver on the one longitudinal end of the mop handle, the mop head including a central member pivotally mounted on the receiver and first and second paddles pivotally coupled with opposing lateral sides of the central member, the central member and paddles being adapted to collectively receive and support an elongated absorbent element on sides of the paddles opposite the mop handle, the central member rotating at least about 90 degrees on the receiver, the central member including a plurality of gear teeth; and a wringer having one end pivotally coupled to one of the central member and the receiver so as to pivot between a retracted position and an extended position, the wringer including a pair of spaced apart arms, ends of the arms being pivotally attached to the one of the central member and receiver, the arms being located to deflect the first and second paddles from initial positions generally coplanar with one another and transverse to the elongated direction of the mop handle to deflected positions rotated about 90° from the initial positions so as to be spaced apart and generally side by side parallel to one another with any elongated absorbent element supported from the mop head folded over between the paddles, as the wringer moves from the retracted position to the extended position.

18. A wringer mop comprising:

a mop handle having an elongated direction between opposing longitudinal ends;

a receiver coupled to one longitudinal end of the handle;

a mop head pivotally attached to the receiver on the one longitudinal end of the mop handle, the mop head including an integral central member pivotally mounted on the receiver and first and second paddles pivotally coupled with opposing lateral sides of the central member, the central member and paddles being adapted to collectively receive and support an elongated absorbent element on sides of the paddles opposite the mop handle, the central member being rotatable more than 90 degrees on the receiver without relative axial displacement between the mop head and the receiver; and a detent between the central member and the receiver releasably engaging the central member and receiver at at least a pair of rotational positions of the central member 90 degrees apart from one another on the receiver.

* * * * *